US011715412B2

(12) United States Patent
Li

(10) Patent No.: US 11,715,412 B2
(45) Date of Patent: Aug. 1, 2023

(54) SELF-LUMINOUS PIXEL CIRCUIT AND DISPLAY PANEL

(71) Applicant: TCL CHINA STAR OPTOELECTRONICS TECHNOLOGY CO., LTD., Shenzhen (CN)

(72) Inventor: Yan Li, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 341 days.

(21) Appl. No.: 17/055,552

(22) PCT Filed: Oct. 15, 2020

(86) PCT No.: PCT/CN2020/121044

§ 371 (c)(1),
(2) Date: Nov. 13, 2020

(87) PCT Pub. No.: WO2022/032857

PCT Pub. Date: Feb. 17, 2022

(65) Prior Publication Data

US 2022/0309994 A1 Sep. 29, 2022

(30) Foreign Application Priority Data

Aug. 11, 2020 (CN) ..... 202010799572.6

(51) Int. Cl.
*G09G 3/32* (2016.01)

(52) U.S. Cl.
CPC ..... *G09G 3/32* (2013.01); *G09G 2300/0842* (2013.01); *G09G 2320/064* (2013.01)

(58) Field of Classification Search
CPC ..... G09G 2300/0842; G09G 3/32; G09G 3/3208; G09G 2320/064; G09G 2320/0633; G09G 3/2074
See application file for complete search history.

(56) References Cited

U.S. PATENT DOCUMENTS 10,803,790 B2 * 10/2020 Cho ..... G09G 3/3208
2007/0114522 A1 5/2007 Kwok et al.
(Continued)

FOREIGN PATENT DOCUMENTS

CN 101147185 A 3/2008
CN 101276543 A 10/2008
(Continued)

OTHER PUBLICATIONS

International Search Report in International application No. PCT/CN2020/121044, dated Apr. 26, 2021.
(Continued)

*Primary Examiner* — Muhammad N Edun
(74) *Attorney, Agent, or Firm* — PV IP PC; Wei Te Chung; Zhigang Ma

(57) ABSTRACT

The present disclosure discloses a self-luminous pixel circuit which includes a driving module and a light emitting module that are connected between a first variable potential and a second variable potential; the driving module controls magnitude of electric current flowing through the light emitting module according to timing control; the self-luminous pixel circuit provided by the present disclosure can be switched to have a high brightness adjustment range via the first variable potential and the second variable potential, thereby increasing the number of gray levels.

20 Claims, 4 Drawing Sheets

(56) References Cited

U.S. PATENT DOCUMENTS

| | | | | |
|---|---|---|---|---|
| 2017/0309224 | A1 | 10/2017 | Pappas et al. | |
| 2019/0069356 | A1* | 2/2019 | Volpato | H05B 45/46 |
| 2020/0220377 | A1* | 7/2020 | Chen | H05B 45/10 |

FOREIGN PATENT DOCUMENTS

| | | | |
|---|---|---|---|
| CN | 101371619 | A | 2/2009 |
| CN | 102612710 | A | 7/2012 |
| CN | 103366682 | A | 10/2013 |
| CN | 103383834 | A | 11/2013 |
| CN | 103489401 | A | 1/2014 |
| CN | 103872251 | A | 6/2014 |
| CN | 105185321 | A | 12/2015 |
| CN | 106816140 | A | 6/2017 |
| CN | 107134256 | A | 9/2017 |
| CN | 108922473 | A | 11/2018 |
| CN | 110136636 | A | 8/2019 |
| CN | 111210772 | A | 5/2020 |

OTHER PUBLICATIONS

Written Opinion of the International Search Authority in International application No. PCT/CN2020/121044, dated Apr. 26, 2021.
Chinese Office Action issued in corresponding Chinese Patent Application No. 202010799572.6 dated May 6, 2021, pp. 1-7.

* cited by examiner

SELF-LUMINOUS PIXEL CIRCUIT AND DISPLAY PANEL

This application is a Notional Phase of PCT Patent Application No. PCT/CN2020/121044 having international filing date of Oct. 15, 2020, which claims priority to Chinese Patent Application No. 202010799572.6 filed on Aug. 11, 2020, the entire contents of which are incorporated by reference in this application.

FIELD OF INVENTION

The present disclosure relates to the field of display technologies, in particular to the field of self-luminous display technology, and in particular to a self-luminous pixel circuit and a display panel.

BACKGROUND OF INVENTION

For a long time, display panels have been developing in the direction of thinning, light weight and flexibility. Organic electroluminescence, quantum dot electroluminescence, and micro electroluminescence self-luminous display panels have native advantages in these aspects. A light emitting device of a self-luminous display has a positive correlation between its luminous brightness and applied voltage and current.

In a conventional technical solution, a self-luminous pixel circuit applied to the above-mentioned self-luminous display panel has a small light emitting brightness range, resulting in a low number of gray levels, which cannot meet the market demand for further increasing the number of gray levels.

SUMMARY OF INVENTION

Technical Problems

The present disclosure provides a self-luminous pixel circuit, which solves the problem that a self-luminous pixel circuit has a small light emitting brightness range, resulting in a low number of gray levels.

Technical Solutions

In a first aspect, the present disclosure provides a self-luminous pixel circuit, which includes a driving module and a light emitting module disposed between a first variable potential and a second variable potential; the driving module is electrically connected with the light emitting module; the driving module controls magnitude of electric current flowing through the light emitting module according to timing control; wherein the light emitting module includes a first light emitting unit and a second light emitting unit that provide different brightness and are disposed in parallel; when the second variable potential is greater than the first variable potential, the first light emitting unit operates at low level brightness; when the first variable potential is greater than the second variable potential, the second light emitting unit operates at high level brightness.

Based on the first aspect, in the first implementation of the first aspect, the second variable potential is connected with a first node of the light emitting module; a second node of the light emitting module is connected with a first end of the driving module; a second node of the driving module is connected with the first variable potential.

Based on the first aspect, in the second implementation of the first aspect, wherein, the second variable potential is connected with a first end of the driving module; a second end of the driving module is connected with a first end of the light emitting module; a second end of the light emitting module is connected with the first variable potential.

Based on the first implementation or the second implementation of the first aspect, in the third implementation of the first aspect, the first light emitting unit is provided with at least one first light emitting device; the second light emitting unit is provided with at least two second light emitting devices connected in series; the first light emitting unit and the second light emitting unit have different duty cycles.

Based on the third implementation of the first aspect, in the fourth implementation of the first aspect, the self-luminous pixel circuit further comprises a writing module; a control node of the writing module is connected with a scanning signal; an input node of the writing module is connected with a data signal; an output node of the writing module is connected with a control node of the driving module.

Based on the fourth implementation of the first aspect, in the fifth implementation of the first aspect, wherein the self-luminous pixel circuit further comprises a storage module; a first node of the storage module is connected with the output node of the writing module and the control node of the driving module; a second node of the storage module is connected with zero potential.

Based on the fifth implementation of the first aspect, in the sixth implementation of the first aspect, the driving module comprises a first thin film transistor; the second variable potential is connected with an input node of the first light emitting unit and an output node of the second light emitting unit; a drain of the first thin film transistor is connected with an output node of the first light emitting unit and an input node of the second light emitting unit; a source of the first thin film transistor is connected with the first variable potential.

Based on the sixth implementation of the first aspect, in the seventh implementation of the first aspect, the writing module comprises a second thin film transistor; the data signal is connected with an input node of the second thin film transistor; the scanning signal is connected with a gate of the second thin film transistor; an output node of the second thin film transistor is connected with a gate of the first thin film transistor Based on the seventh implementation of the first aspect, in the eighth implementation of the first aspect, the storage unit comprises a storage capacitor; a first node of the storage capacitor is connected with the output node of the second thin film transistor and the gate of the first thin film transistor; a second node of the storage capacitor is connected with the zero potential.

In a second aspect, the present disclosure provides a display panel which comprises the self-luminous pixel circuit in any of the above implementation.

Beneficial Effect

The self-luminous pixel circuit provided by the present disclosure can be switched to have a high brightness adjustment range via the first variable potential and the second variable potential, thereby further increasing the number of gray levels.

DETAILED DESCRIPTION OF PREFERRED EMBODIMENTS

To clarify the purpose, technical solutions, and effects of the present disclosure, the present disclosure will be further described in detail below with reference to the accompanying drawings and embodiments. It is understood that the specific embodiments described herein are merely illustrative of the present disclosure and are not intended to limit the present disclosure.

Figure 1:
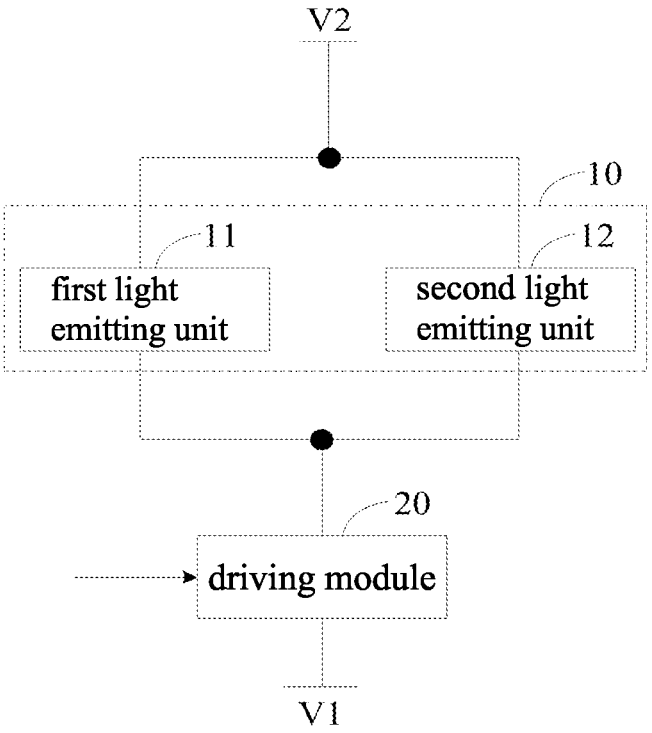
FIG. 1 is a first structurally schematic diagram of a self-luminous pixel circuit provided by an embodiment of the disclosure.
Figure 2:
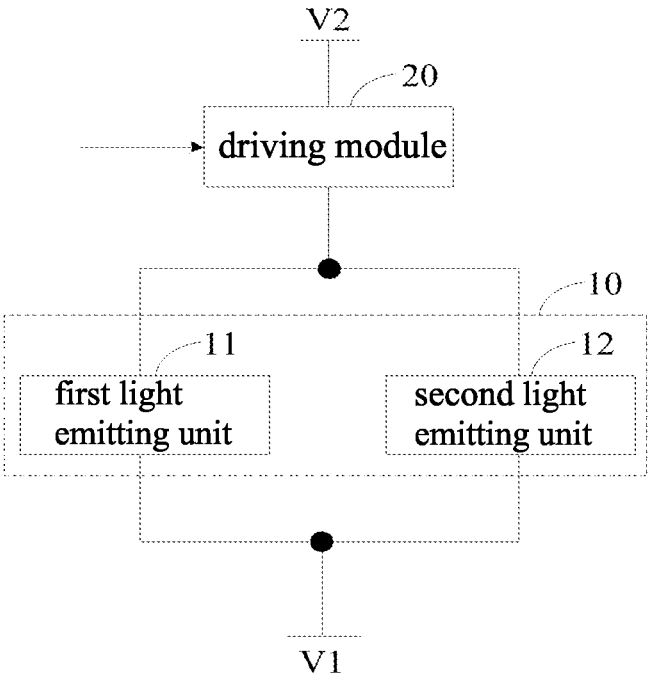
FIG. 2 is a second structurally schematic diagram of a self-luminous pixel circuit provided by an embodiment of the disclosure.

As shown in FIG. 1 or FIG. 2, this embodiment provides a self-luminous pixel circuit, which includes a driving module 20 and a light emitting module 10 connected together between a first variable potential V1 and a second variable potential V2. The driving module 20 controls magnitude of electric current flowing through the light emitting module 10 according to timing control; wherein the light emitting module 10 includes a first light emitting unit 11 and a second light emitting unit 12 that provide different brightness and are disposed in parallel. When the second variable potential V2 is greater than the first variable potential V1, the first light emitting unit 11 operates at low level brightness. When the first variable potential V1 is greater than the second variable potential V2, the second light emitting unit 12 operates at high level brightness.

Figure 4:
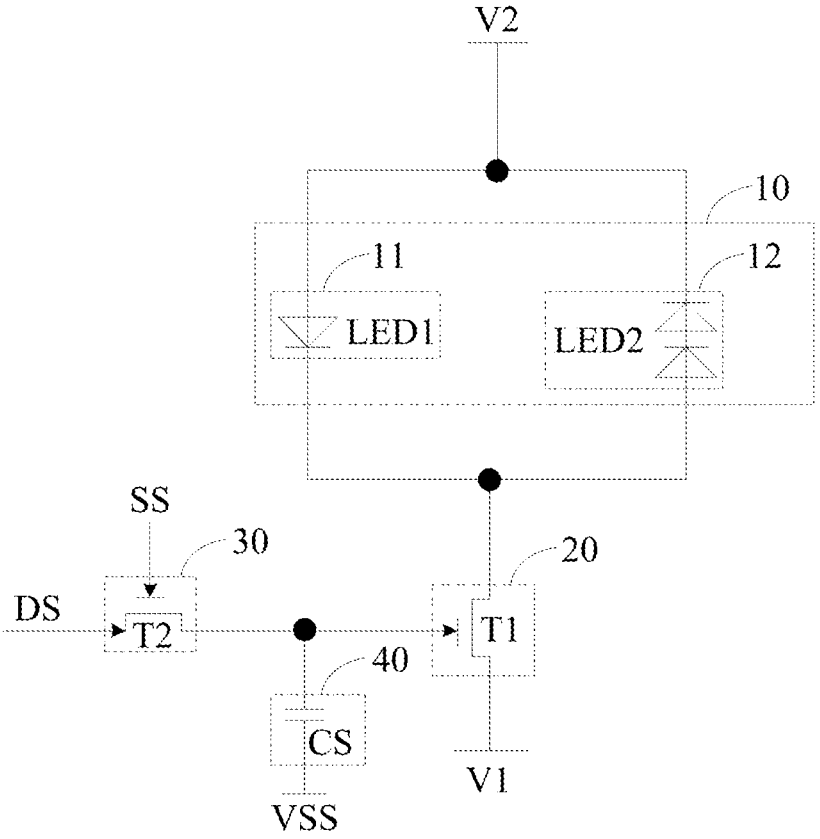
FIG. 4 is a circuit principle diagram of a self-luminous pixel circuit shown in FIG. 3.
Figure 5:
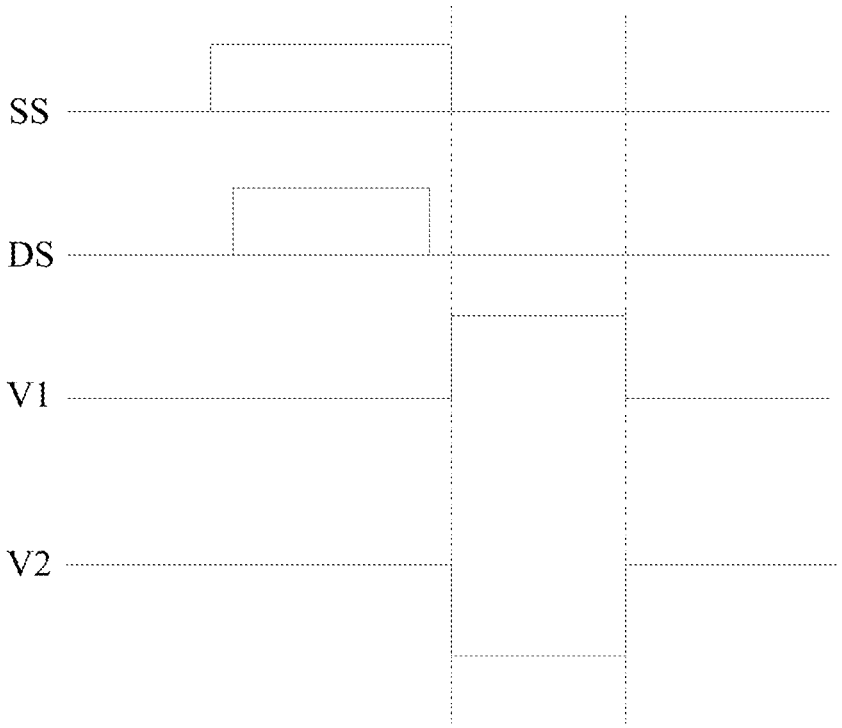
FIG. 5 is a timing diagram of a self-luminous pixel circuit shown in FIG. 4.

As shown in FIG. 4 or FIG. 5, it should be noted that the light emitting brightness of the second light emitting unit 12 is greater than that of the first light emitting unit 11: the first light emitting unit 11 is provided with at least one first light emitting device LED1. The light emitting unit 12 is provided with at least two second light emitting devices LED2 connected in series sequentially; the duty cycles of the first light emitting unit 11 and the second light emitting unit 12 are different, that is, only one light emitting unit of the two light emitting units stay at a light emitting display status at any time.

It can be understood that the first light emitting device LED1 may be, but not limited to, the same as the second light emitting device LED2, or may be different. Both the first light emitting device LED1 and the second light emitting device LED2 can be one of an organic electroluminescent device, a quantum dot electroluminescent device and a miniature electroluminescent device.

It should be noted that when different light emitting units are in operation, the potential difference between the first variable potential V1 and the second variable potential V2 may be different, and the potential difference may be adjusted according to the number of the light emitting devices in a corresponding light emitting unit, so as to meet the potential difference required by the different light emitting units.

Figure 3:
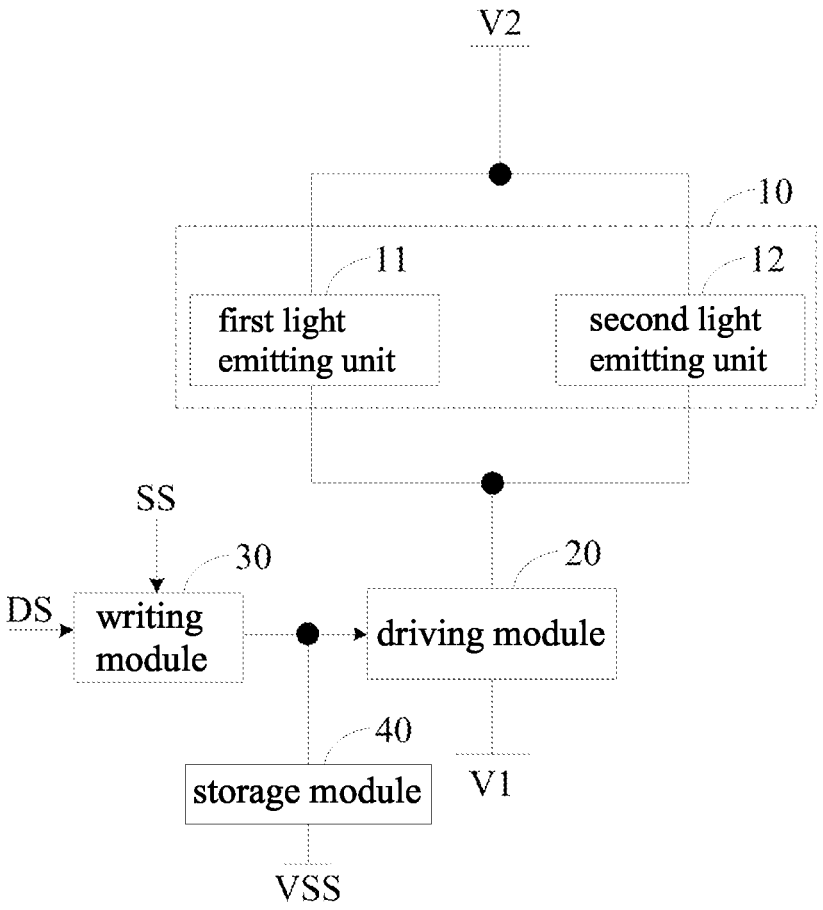
FIG. 3 is a third structurally schematic diagram of a self-luminous pixel circuit provided by an embodiment of the disclosure.

As shown in FIG. 3, it can be understood that the driving module 20 controls the electric current flowing through the light emitting module 10 according to timing control: light emitting duration and light emitting brightness of the light emitting module 10 are controlled according to a timing sequence constructed by a charging state of the storage module 40 controlled by a writing module 30 and a discharge state of the driving module 20 to the storage module 40. The self-luminous pixel circuit also includes the writing module 30; a control node the writing module 30 is connected with a scan signal SS; an input node of the writing module 30 is connected with a data signal DS; an output node of the writing module 30 is connected with a control node of the driving module 20.

As shown in FIG. 3, the self-luminous pixel circuit further includes a storage module 40; a first node of the storage module 40 is connected with the output node of the writing module 30 and the control node of the driving module 20; a second node of the storage module 40 is connected with zero potential VSS.

As shown in FIG. 1, in one of the embodiments, the second variable potential V2 is connected with a first node of the light emitting module 10; a second node of the light emitting module 10 is connected with a first node of the driving module 20; a second node of the driving module 20 is connected with the first variable potential V1.

As shown in FIG. 2, in one of the embodiments, the second variable potential V2 is connected with the first node of the driving module 20; the second node of the driving module 20 is connected with the first node of the light emitting module 10; the second node of the light emitting module 10 is connected with the first variable potential V1.

As shown in FIG. 4, in one of the embodiments, the driving module 20 includes a first thin film transistor T1. The second variable potential V2 is connected with an input node of the first light emitting unit 11 and an output node of the second light emitting unit 12. A drain of the first thin film transistor T1 is connected with an output node of the first light emitting unit 11 and an input node of the second light emitting unit 12. A source of the first thin film transistor T1 is connected with the first variable potential V1.

It can be understood that, when it is guaranteed that the first thin film transistor T1 can be turned on, and, that is, its threshold voltage is greater than a voltage between the gate and the source, the drain and the source of the first thin film transistor T1 can be used interchangeably.

As shown in FIG. 4, in one of the embodiments, the writing module 30 includes a second thin film transistor T2; the data signal DS is connected with an input node of the second thin film transistor T2; the scan signal SS is connected with a gate of the second thin film transistor T2; an output node of the second thin film transistor T2 is connected with the gate of the first thin film transistor T1.

It can be understood that the input node and the output node of the second thin film transistor T2 can be used interchangeably, and can be a source or a drain.

It should be noted that the first thin film transistor T1 and the second thin film transistor T2 can be, but not limited to, N-type thin film transistors.

As shown in FIG. 4, in one of the embodiments, the storage unit includes a storage capacitor CS; the first node of the storage capacitor CS is connected with the output node of the second thin film transistor T2 and the gate of the first thin film transistor T1; the second node of the storage capacitor CS is connected with the zero potential VSS.

FIG. 5 shows the working process of the present disclosure: when the scan signal SS is in a high potential state, the second thin film transistor T2 is turned on, and the high potential data signal DS is written into the storage capacitor CS. When entering the light emitting phase, the storage capacitor CS is discharged to open the gate of the second thin film transistor T2: if the second variable potential V2 is greater than the first variable potential V1, the second light emitting unit 12 does not emit light, and the first light emitting unit 11 operates at low level brightness, with the number of gray levels in the traditional technical solution; when the first variable potential V1 is greater than the second variable potential V2, the first light emitting unit 11 does not emit light, and the second light emitting unit 12 operates at high level brightness, with a great number of gray levels.

In one of the embodiments, the present disclosure provides a display panel, which includes the self-luminous pixel circuit in any of the above embodiments.

It can be understood that a plurality of self-luminous pixel circuits are arranged in an array in the display panel.

It can be understood that for those of ordinary skill in the art, equivalent substitutions or changes can be made according to the technical solutions and inventive concepts of the present disclosure, and all these changes or substitutions shall fall within the protection scope of the appended claims of the present disclosure.

What is claimed is:

1. A self-luminous pixel circuit, comprising:

a driving module and a light emitting module disposed between a first variable potential and a second variable potential; the driving module is electrically connected with the light emitting module; the driving module controls magnitude of electric current flowing through the light emitting module according to timing control;

wherein, the light emitting module includes a first light emitting unit and a second light emitting unit that provide different brightness and are disposed in parallel; when the second variable potential is greater than the first variable potential, the first light emitting unit operates at a low level brightness; when the first variable potential is greater than the second variable potential, the second light emitting unit operates at a high level brightness;

wherein, the second variable potential is connected with a first end of the driving module; a second end of the driving module is connected with a first end of the light emitting module;

a second end of the light emitting module is connected with the first variable potential;

wherein the first light emitting unit is provided with at least one first light emitting device, and the second light emitting unit is provided with at least two second light emitting devices connected in series; and wherein a potential difference between the first variable potential and the second variable potential in response to the first light emitting unit being in operation is different from a potential difference between the first variable potential and the second variable potential in response to the second light emitting unit being in operation, and the two potential differences are respectively adjusted according to a number of the at least one first light emitting device and a number of the at least two second light emitting devices.

2. The self-luminous pixel circuit according to claim 1, wherein the first light emitting unit and the second light emitting unit have different duty cycles.

3. The self-luminous pixel circuit according to claim 2, wherein the self-luminous pixel circuit further comprises a writing module;

a control node of the writing module is connected with a scanning signal; an input node of the writing module is connected with a data signal; an output node of the writing module is connected with a control node of the driving module.

4. The self-luminous pixel circuit according to claim 3, wherein the self-luminous pixel circuit further comprises a storage module;

a first node of the storage module is connected with the output node of the writing module and the control node of the driving module; a second node of the storage module is connected with zero potential.

5. The self-luminous pixel circuit according to claim 4, wherein the driving module comprises a first thin film transistor.

6. The self-luminous pixel circuit according to claim 5, wherein the writing module comprises a second thin film transistor.

7. The self-luminous pixel circuit according to claim 6, wherein the storage module comprises a storage capacitor; a first node of the storage capacitor is connected with the output node of the second thin film transistor and the gate of the first thin film transistor; a second node of the storage capacitor is connected with the zero potential.

8. A self-luminous pixel circuit, comprising:

a driving module and a light emitting module disposed between a first variable potential and a second variable potential; the driving module is electrically connected with the light emitting module; the driving module controls magnitude of electric current flowing through the light emitting module according to timing control;

wherein, the light emitting module includes a first light emitting unit and a second light emitting unit that provide different brightness and are disposed in parallel; when the second variable potential is greater than the first variable potential, the first light emitting unit operates at low level brightness; when the first variable potential is greater than the second variable potential, the second light emitting unit operates at high level brightness;

wherein the first light emitting unit is provided with at least one first light emitting device, and the second light emitting unit is provided with at least two second light emitting devices connected in series; and wherein a potential difference between the first variable potential and the second variable potential in response to the first light emitting unit being in operation is different from a potential difference between the first variable potential and the second variable potential in response to the second light emitting unit being in operation, and the two potential differences are respectively adjusted according to a number of the at least one first light emitting device and a number of the at least two second light emitting devices.

9. The self-luminous pixel circuit according to claim 8, wherein the second variable potential is connected with a first node of the light emitting module; a second node of the light emitting module is connected with a first end of the driving module; a second node of the driving module is connected with the first variable potential.

10. The self-luminous pixel circuit according to claim 9, wherein the first light emitting unit and the second light emitting unit have different duty cycles.

11. The self-luminous pixel circuit according to claim 10, wherein the self-luminous pixel circuit further comprises a writing module;

a control node of the writing module is connected with a scanning signal; an input node of the writing module is connected with a data signal; an output node of the writing module is connected with a control node of the driving module.

12. The self-luminous pixel circuit according to claim 11, wherein the self-luminous pixel circuit further comprises a storage module;

a first node of the storage module is connected with the output node of the writing module and the control node of the driving module; a second node of the storage module is connected with zero potential.

13. The self-luminous pixel circuit according to claim 12, wherein the driving module comprises a first thin film transistor;

the second variable potential is connected with an input node of the first light emitting unit and an output node of the second light emitting unit; a drain of the first thin film transistor is connected with an output node of the first light emitting unit and an input node of the second light emitting unit; a source of the first thin film transistor is connected with the first variable potential.

14. The self-luminous pixel circuit according to claim 13, wherein the writing module comprises a second thin film transistor; the data signal is connected with an input node of the second thin film transistor; the scanning signal is connected with a gate of the second thin film transistor; an output node of the second thin film transistor is connected with a gate of the first thin film transistor.

15. The self-luminous pixel circuit according to claim 14, wherein the storage module comprises a storage capacitor; a first node of the storage capacitor is connected with the output node of the second thin film transistor and the gate of the first thin film transistor; a second node of the storage capacitor is connected with the zero potential.

16. A display panel, comprising the self-luminous pixel circuit as claimed in claim 8.

17. The display panel according to claim 16, wherein the display panel includes a plurality of said self-luminous pixel circuits arranged in an array.

18. The display panel according to claim 17, wherein the second variable potential is connected with a first node of the light emitting module; a second node of the light emitting module is connected with a first end of the driving module; a second node of the driving module is connected with the first variable potential.

19. The display panel according to claim 18, wherein the first light emitting unit and the second light emitting unit have different duty cycles.

20. The display panel according to claim 19, wherein the self-luminous pixel circuit further comprises a writing module;

a control node of the writing module is connected with a scanning signal; an input node of the writing module is connected with a data signal; an output node of the writing module is connected with a control node of the driving module.

* * * * *